US009868047B2

(12) United States Patent
Lapierre et al.

(10) Patent No.: US 9,868,047 B2
(45) Date of Patent: Jan. 16, 2018

(54) BRAKING DEVICE FOR A BINDING FOR A GLIDING BOARD

(71) Applicant: SALOMON S.A.S., Metz-Tessy (FR)

(72) Inventors: Stéphane Lapierre, Argonay (FR); Laurent Damiani, Villaz (FR); François Convert, Villy le Pelloux (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 15/248,393

(22) Filed: Aug. 26, 2016

(65) Prior Publication Data

US 2017/0056755 A1 Mar. 2, 2017

(30) Foreign Application Priority Data

Aug. 27, 2015 (FR) ..... 15 01787

(51) Int. Cl.
*A63C 7/10* (2006.01)
*A63C 9/00* (2012.01)
*A63C 9/08* (2012.01)

(52) U.S. Cl.
CPC ..... *A63C 7/108* (2013.01); *A63C 7/102* (2013.01); *A63C 9/006* (2013.01); *A63C 9/0807* (2013.01)

(58) Field of Classification Search
CPC ..... A63C 7/108; A63C 7/102; A63C 9/006; A63C 9/0807
(Continued)

(56) References Cited

U.S. PATENT DOCUMENTS 4,101,145 A * 7/1978 Korger ..... A63C 7/104 280/605
4,359,235 A * 11/1982 Wittmann ..... A63C 7/1026 188/6
(Continued)

FOREIGN PATENT DOCUMENTS

EP 0 366 942 A2 5/1990
EP 2 666 525 A1 11/2013
(Continued)

*Primary Examiner* — Thomas J Williams
*Assistant Examiner* — Mariano Sy
(74) *Attorney, Agent, or Firm* — Greenblum & Bernstein, P.L.C.

(57) ABSTRACT

Braking device for a gliding board that includes: a base to be affixed to the gliding board; at least one braking arm pivotable about a first substantially transverse axis, the braking arm including a control element extending along an axis substantially parallel to the first axis; a movable support plate including a control element housing, the position of the control element in the guiding housing varying as a function of the angular position of the braking arm; an elastic mechanism acting on the control element along an actuation direction varying as a function of the angular position of the braking arm. The support plate is displaced by an amplitude covering a first positioning range for which the base, the braking arm, the support plate, and the elastic mechanism are arranged so that the elastic mechanism acts on the control element to cause rotation of the braking arm in a first direction, as well as a second positioning range for which the base, the braking arm, the support plate, and the elastic mechanism are arranged so that the elastic mechanism acts on the control element to cause rotation of the braking arm in a second direction, opposite the first direction of rotation.

14 Claims, 9 Drawing Sheets

(58) Field of Classification Search
USPC ..... 188/6, 5, 8; 280/605
See application file for complete search history.

(56) References Cited

U.S. PATENT DOCUMENTS

| | | | | | |
|---|---|---|---|---|---|
| 4,361,343 | A * | 11/1982 | Luitz | A63C 7/1033 | 188/6 |
| 4,379,570 | A * | 4/1983 | Sedlmair | A63C 7/102 | 280/605 |
| 4,383,699 | A | 5/1983 | Beyl | | |
| 4,463,967 | A * | 8/1984 | Klubitschko | A63C 7/104 | 280/605 |
| 4,544,177 | A * | 10/1985 | Svoboda | A63C 7/104 | 280/605 |
| 4,564,211 | A * | 1/1986 | Luitz | A63C 7/104 | 280/605 |
| 4,973,072 | A * | 11/1990 | Stritzl | A63C 7/104 | 280/605 |
| 5,033,766 | A | 7/1991 | Sedlmair et al. | | |
| 7,819,418 | B2 | 10/2010 | Buquet et al. | | |
| 2006/0279068 | A1 * | 12/2006 | Buquet | A63C 7/102 | 280/605 |
| 2011/0203138 | A1 | 8/2011 | Shute et al. | | |
| 2013/0062861 | A1 * | 3/2013 | Desarmaux | A63C 7/1026 | 280/605 |
| 2013/0181427 | A1 | 7/2013 | Fritschi | | |
| 2013/0307252 | A1 * | 11/2013 | Crema | A63C 7/1053 | 280/617 |
| 2014/0070519 | A1 * | 3/2014 | Fritschi | A63C 9/006 | 280/623 |

FOREIGN PATENT DOCUMENTS

| | | | |
|---|---|---|---|
| EP | 2 774 660 | A2 | 9/2014 |
| FR | 2 278 363 | A1 | 2/1976 |
| FR | 2 766 100 | A1 | 1/1999 |
| WO | WO-2009/105866 | A1 | 9/2009 |
| WO | WO-2012/024809 | A1 | 3/2012 |

* cited by examiner

BRAKING DEVICE FOR A BINDING FOR A GLIDING BOARD

CROSS-REFERENCE TO RELATED APPLICATION

This application is based upon French Patent Application No. FR 15/01787, filed Aug. 27, 2015, the disclosure of which is hereby incorporated by reference thereto in its entirety, and the priority of which is claimed under 35 U.S.C. §119.

BACKGROUND

1. Field of the Invention

The invention relates to a braking device for a binding for a gliding board, such as a ski, for example. The invention can be particularly suitable for a dual-purpose gliding board used particularly for both the practice of alpine skiing and the practice of ski touring. In the first case, the brake must be continually operational so that it can be activated and stop the displacement of the ski as soon as the skier triggers or releases the binding. In the second case, the brake must be able to be disabled so as to remain inactive when the rider/skier lifts the heel of the boot, so as not to slow down his/her displacement.

2. Background Information

Conventionally, a braking device comprises two lateral braking arms, each arm pivoting about an axis transverse to the ski on which it is mounted. Elastic mechanisms tend to maintain the arms in an active braking position, in which the arms are sufficiently inclined in relation to the ski sole, so that a portion projects downward from the ski sole to engage the snow. To deactivate the brake, it suffices to pivot the braking arms so as to raise the portion adapted to engage the snow above the ski sole. The arms are then in a gliding position.

During use in alpine skiing, the arms are maintained in the gliding position by the heel of the boot, when the boot is engaged with the binding.

During use in ski touring, the boot pivots about a transverse axis positioned at the front of the boot. Consequently, the brake is released as soon as the skier raises the heel. To avoid braking the ski with each step, a device should be provided for locking the brake in an inactive configuration, in which the arms are maintained in a gliding position.

To this end, a number of documents describe braking devices equipped with a lock for maintaining the arms in a gliding position. Such constructions are disclosed, for example, in the patent documents EP 2 259 850, EP 2 666 525, WO 2012/024809, US 2011/0203138, and US 2013/0181427.

All of these constructions include an element blocking the rotation of the arms to maintain them in a gliding position. In these solutions, an elastic mechanism exerts a force on the arms so as to pivot them in only one direction of rotation. This means that the locked configuration of the brake is an unstable position which is maintained only by the lock. Thus, the lock is continuously biased when blocking the arms. The lock must be dimensioned accordingly.

SUMMARY

The invention provides an improved braking device.

In particular, the invention provides a safe and reliable braking device.

The invention also includes a reduced number of constituent elements for the braking device.

The invention provides a braking device for a gliding board comprising:

- a base provided to be affixed to the gliding board;
- at least one braking arm that is pivotable in relation to the base about a first axis of rotation substantially transverse to the gliding board, the braking arm comprising a control element extending along an axis substantially parallel to the first axis of rotation;
- a support plate movable in relation to the base, the support plate comprising a housing for guiding the control element, the position of the control element in the guiding housing varying as a function of the angular position of the braking arm;
- an elastic mechanism acting on the control element along an actuation direction varying as a function of the angular position of the braking arm.

The support plate of the device is configured to be displaced by an amplitude covering at least two positioning ranges, namely:

- a first positioning range for which the base, the braking arm, the support plate, and the elastic mechanism are arranged so that the elastic mechanism acts on the control element so as to cause rotation of the braking arm in a first direction; and
- a second positioning range for which the base, the braking arm, the support plate, and the elastic mechanism are arranged so that the elastic mechanism acts on the control element so as to cause rotation of the braking arm in a second direction, opposite the first direction of rotation.

Due to the invention, the device can rotate the arms alternately in one direction or in the opposite direction. This makes it possible to provide two stable positions for the braking arm(s): an active braking position (in one direction) and a gliding position (in the other direction). This construction does not require an additional locking element, and thereby makes it possible to simplify the design. Furthermore, the absence of additional locking element for maintaining the device in an unstable position results in increased reliability of the mechanism. The latter then alternates between two stable configurations. The arms are securely blocked in the gliding position. Indeed, in conventional constructions, the arms automatically switch to an active braking position if the lock breaks. In the proposed construction, there is no need for a lock. Furthermore, the constituent elements are not biased; the dimensioning can therefore be optimized.

According to advantageous but non-essential aspects of the invention, such a braking device may incorporate one or more of the following characteristics, taken in any technically feasible combination:

- The support plate is pivotable, in relation to the base, about a second axis of rotation substantially parallel to the first axis of rotation.
- The braking device comprises a lock that is switchable to an abutment configuration in which the lock is capable of interacting with the support plate so as to limit its rotation, so that the support plate can only remain in its first positioning range.
- The braking device comprises a first actuator capable of interacting with the support plate so as to cause rotation of the support plate, in order to switch it from its first positioning range to its second positioning range.
- The braking device comprises a second actuator capable of interacting with the support plate so as to cause rotation of the support plate, in order to switch it from its second positioning range to its first positioning range.

The lock, the first actuator, and the second actuator form a unitary element.

The element forming the lock, the first actuator, and the second actuator pivots, in relation to the base, about a third axis of rotation substantially parallel to the second axis of rotation.

The braking device comprises a retractable wedge, configured to interact with a heel of a boot so as to limit the vertical displacement of the heel in the direction of the gliding board, so that the heel cannot cooperate with a fixing element of a heel-piece affixed to the gliding board.

The braking device comprises a retaining mechanism for retaining the support plate in its second positioning range.

The retaining mechanism is formed by an interaction between an element of the support plate and an element of an actuating lever, the actuating lever moving along a direction distinct from that of the support plate.

BRIEF DESCRIPTION OF DRAWINGS

Other characteristics and advantages of the invention will be better understood from the description that follows, with reference to the annexed drawings illustrating, by way of non-limiting embodiments, how the invention can be carried out, and in which.

DETAILED DESCRIPTION

Figure 1:
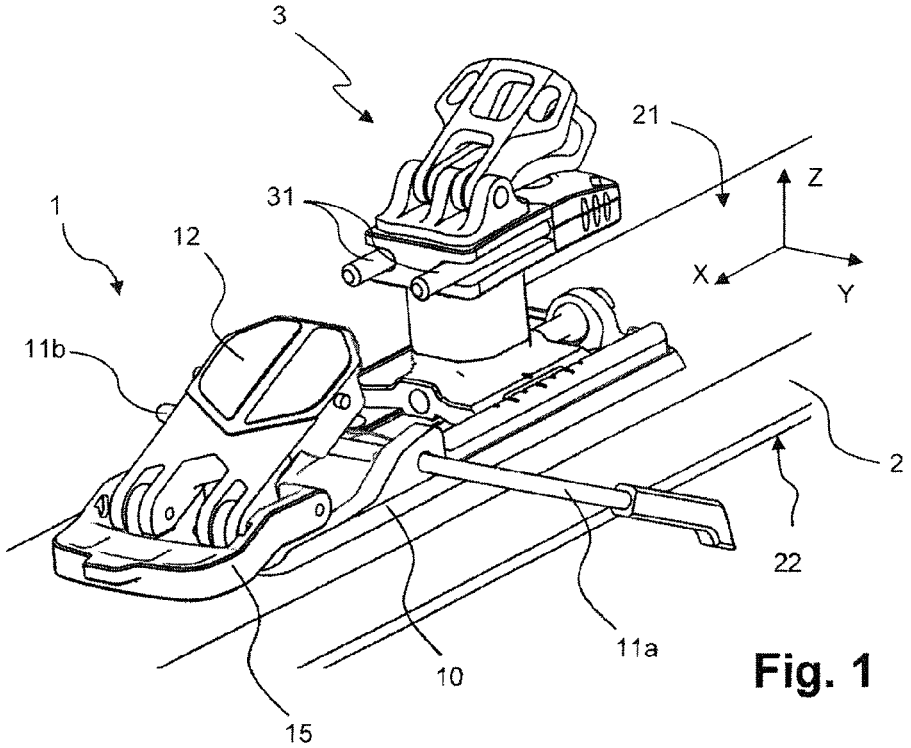
FIG. 1 is a perspective front view of a ski equipped with a heel-piece and of a braking device according to the invention, in the braking configuration.
Figure 2:
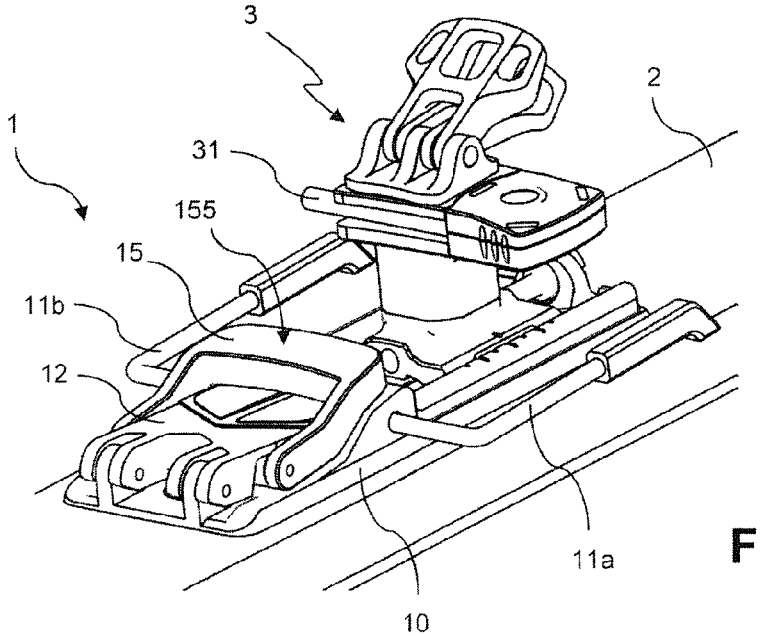
FIG. 2 is a perspective front view of the fitted ski of FIG. 1, the braking device being locked in the gliding configuration.
Figure 3:
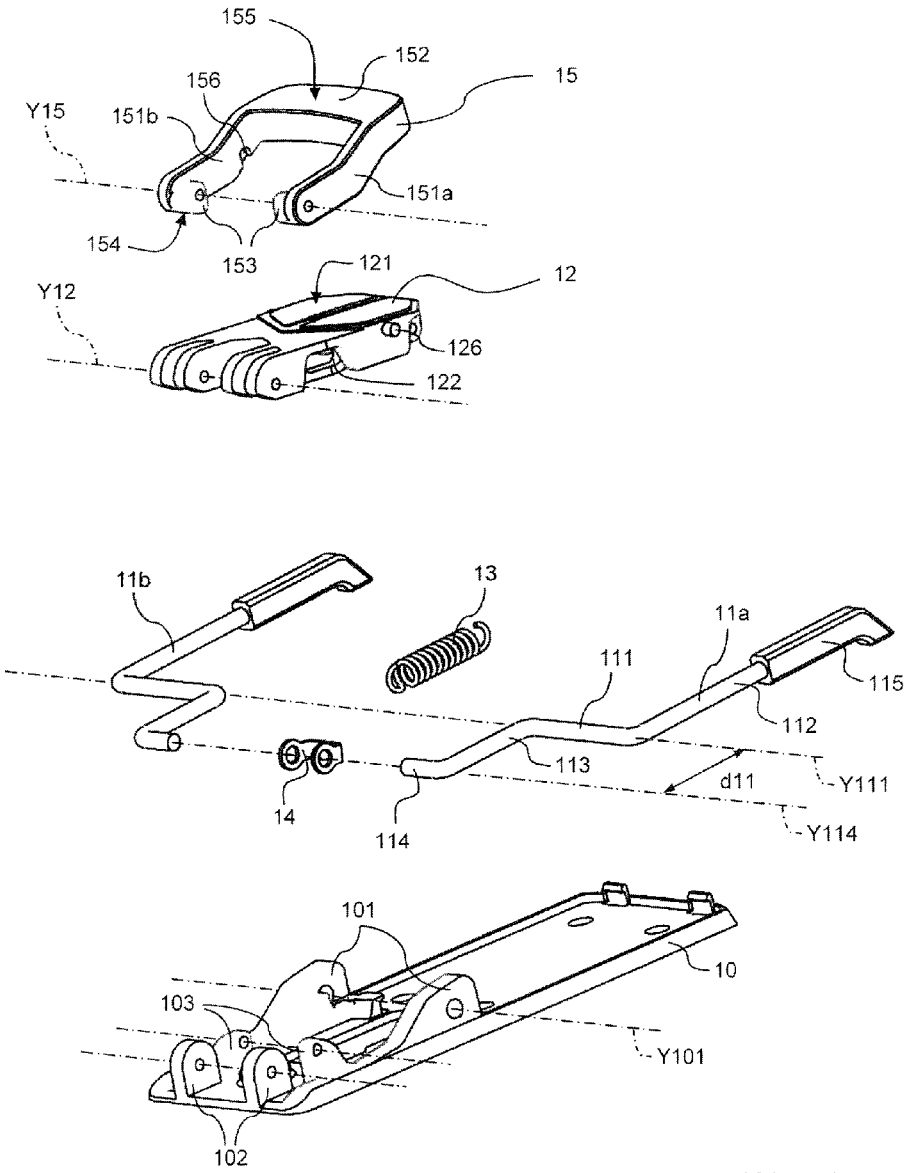
FIG. 3 is an exploded perspective view of the braking device.
Figure 4:
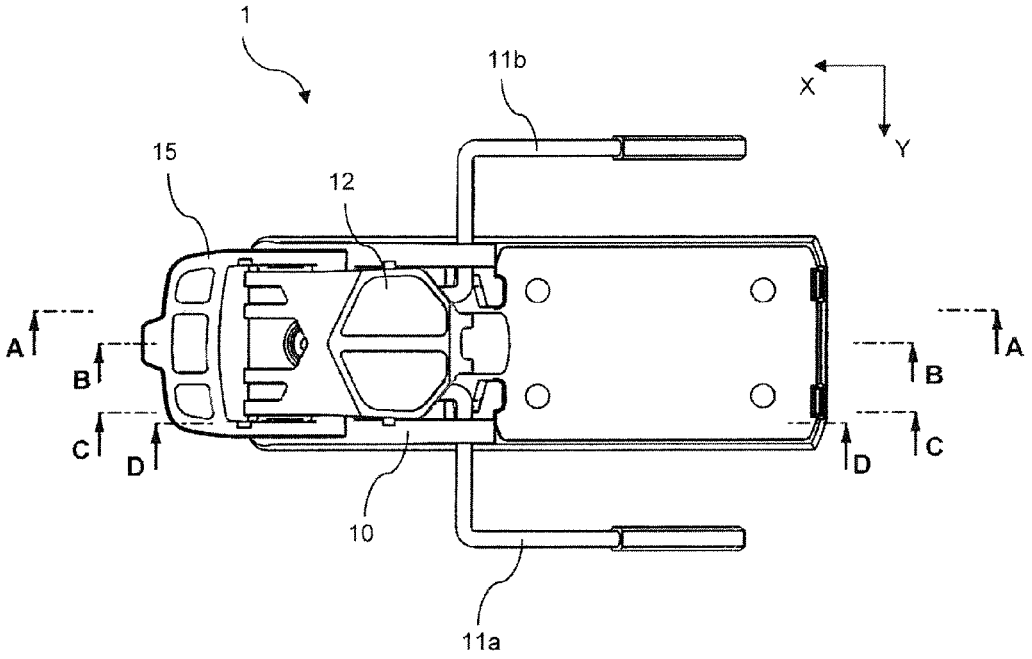
FIG. 4 is a top view of the braking device.
Figure 5:
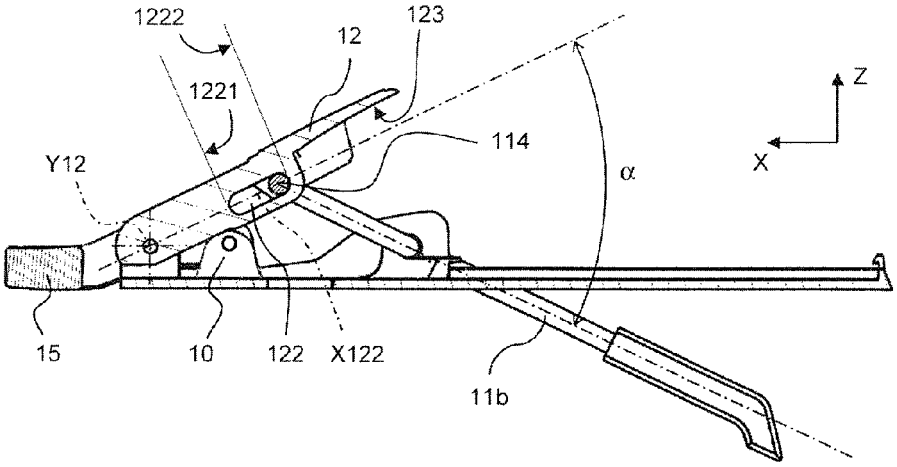
FIGS. 5 and 6 are cross-sectional views, along the line A-A of FIG. 4, illustrating the braking device in the braking configuration and the braking device in the locked gliding configuration, respectively.

The invention is described with reference to an embodiment shown in FIGS. 1 to 15 and it relates to a braking device 1 assembled on a gliding apparatus 2, such as a ski, for example. In this particular case, the braking device is associated with a binding for a boot 4 on the ski. The binding comprises a front retaining device, called a "toe-piece", not shown, and a rear retaining device 3, called a "heel-piece", illustrated in FIGS. 1 and 2. The front and rear retaining devices are configured to affix the front and rear of the boot, respectively, to the gliding apparatus. In the downhill configuration, the two retaining devices cooperate with the boot. In the uphill configuration, only the front retaining device cooperates with the boot. Although the toe-piece (front retaining device) is not shown, it can be any of a plurality of such devices known to those skilled in the art, such as that depicted in the aforementioned US 2011/0203138, the disclosure of which is hereby incorporated by reference thereto in its entirety.

The following description makes use of terms such as "horizontal", "vertical", "longitudinal", "transverse", "upper," "lower," "top," "bottom," "front," and "rear". These terms should be considered as relative terms in relation to the normal position occupied by the braking device on a ski, and to the normal direction of forward displacement of the ski. For example, the term "longitudinal" means in relation to the longitudinal axis of the ski.

Also used is a reference point, whose longitudinal or front/rear direction corresponds to the axis X, transverse or left/right direction corresponds to the axis Y, and vertical or up/down direction corresponds to the axis Z. See, for example, the coordinates shown in FIG. 1 and others.

The braking device 1 includes a base 10 configured to be affixed to the gliding board. Thus, the base is stationary in relation to the ski when the base is mounted on and assembled to the ski. In this example, the base is fixed directly to the upper surface 21 of the gliding board or ski 2. Alternatively, the base can be mounted to slide longitudinally in relation to the ski, in order to enable longitudinal adjustment of its position. Once adjusted, the base is then immobilized longitudinally to be affixed to the ski. Alternatively, the base is fixed to the body of the heel-piece 3.

In this embodiment, the braking device 1 also comprises two braking arms 11*a*, 11*b*, arranged symmetrically with respect to the longitudinal median plane XZ of the ski. Because the two braking arms 11*a*, 11*b* operate in the same manner, only one arm 11*a* is described hereinafter. The other braking arm 11*b* is comprised of like elements and it is arranged symmetrically in relation to the vertical median plane XZ.

The braking arm 11*a* comprises a cylindrical central portion 111 extending along an axis of revolution Y111. On one side, at its outer end, the central portion 111 is extended by a cylindrical outer portion 112, along a first direction substantially perpendicular to the axis Y111. On the other side, at its median end, the central portion 111 is extended by a cylindrical inner portion 113, along a second direction substantially perpendicular to the axis Y111. This second direction is opposite the first direction. The first and second directions are substantially parallel. The inner portion 113 is bent. It is thus extended by a cylindrical control portion 114, extending along an axis of revolution Y114, substantially parallel to the axis Y111, and spaced from the axis Y111 by a length d11. The control portion 114 is called a "control element" hereinafter. The four portions 111, 112, 113, 114 that form the brake arm 11*a* are successively joined in the same plane. In other words, the braking arm forms a "W", with its four portions at successive right angles.

The braking arm 11*a* is assembled to the base 10 in the area of its central portion 111 by a pivot connection. The base 10 thus comprises a lateral bearing 101 having an axis of revolution Y101, substantially transverse to the ski (which contemplates a variation from transverse as mentioned above). This bearing makes it possible to guide the braking arm rotationally about its axis Y111. When the brake is assembled, the axis of revolution Y111 of the central portion and the axis of revolution Y101 of the bearing are substantially merged and define a first axis of rotation Y11 of the braking arm. To obtain the lateral bearing 101, the base may comprise two portions to facilitate assembly of the braking arm.

The braking arm 11*a* and the base 10 are arranged in relation to the ski so that the lateral position (Y) of the outer portion 112 is spaced from the lateral side of the ski. Thus, when the braking arm rotates around its axis Y11, in a first direction S1 (see FIG. 9, for example), the outer portion 112 tilts so that its free end projects downward from the sole 22 of the ski to engage the snow. This configuration of the braking device is referred to as the braking configuration. The displacement is stopped, or at least slowed, by the portion of the outer portion 112 projecting from the sole and interacting with the snow. To improve the grip, the free end can be equipped with an end piece 115. Furthermore, when the braking arm rotates about its axis Y11, in a second direction S2 opposite the first direction S1, the outer portion 112 returns to an upwardly retracted position in relation to the ski sole 22. In this configuration of the braking device, referred to as the gliding configuration, no portion of the braking arm projects downwardly from the ski sole 22. The braking device does not impede the movement of the ski.

The inner portion of the braking arm 11*a*, and more particularly the control element 114, is used to rotate the braking arm. By being oriented substantially parallel to the axis 111 and at distance d11 therefrom, the control element 114 makes it possible to control the rotation of the braking arm. Thus, the control element can move along a circular arc centered on the axis of rotation Y11.

To control the displacement of the control member 114, the braking device comprises a support plate 12 pivotally mounted, in relation to the base 10, about a second axis of rotation Y12. The base 10 comprises bearings 102 for rotationally guiding the support plate 12. The second axis of rotation Y12 is substantially parallel to the first axis of rotation Y11 and offset towards the front of the base. The support plate 12 comprises an upper surface 121 configured to come into contact with a sole 41 of the ski boot 4. On each lateral side, the support plate comprises a guiding housing 122 for the control element 114 of a braking arm 11*a*, 11*b*. This guiding housing 122 is in the form of an elongated opening extending along a direction X122. The guiding housing 122 is longitudinally demarcated by a front surface 1221 and a rear surface 1222. The height of the guiding housing is slightly greater than the diameter of the control element 114. The control element 114 is configured to be inserted into the guiding housing 122, and to move along the elongated hole. Consequently, when the support plate 12 rotates about its axis of rotation Y12, it causes displacement of the control element 114 in its guiding housing 122, thereby resulting in the rotation of the associated braking arm 11*a*, 11*b* about its axis of rotation Y11.

The braking device may take on any of a plurality of configurations.

A first extreme configuration, the so-called braking configuration, is illustrated in FIGS. 1, 5, 7, and 9. The support plate 12 is raised until the control element 114 abuts against the rear surface 1222 of the guiding housing 122. In this case, the braking arm 11*a* can no longer rotate further in the first direction S1. The end of the outer portion 112 projects beyond the sole of the ski and is configured to engage the snow. In this configuration, the axis of rotation Y114 of the control element 114 is positioned above the plane defined by the first axis of rotation Y11 and the second axis of rotation Y12. The angle $\alpha$ between the plane of the braking arm and the upper surface 121 is less than 90 degrees, and, in certain embodiments, less than 60 degrees, in order to facilitate rotation of the support plate 12, without being hindered by the braking arm.

Figure 11:
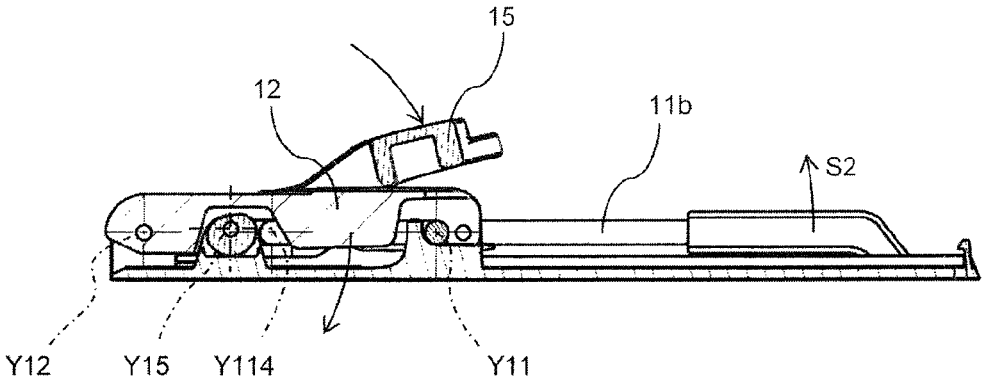
Figure 12:
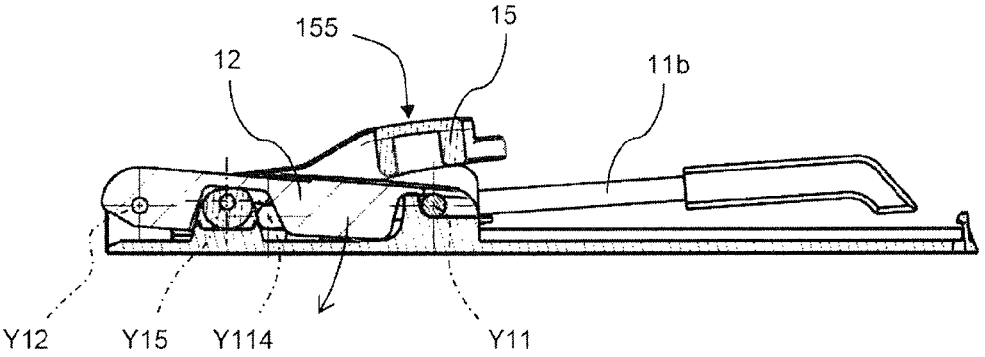
Figure 13:
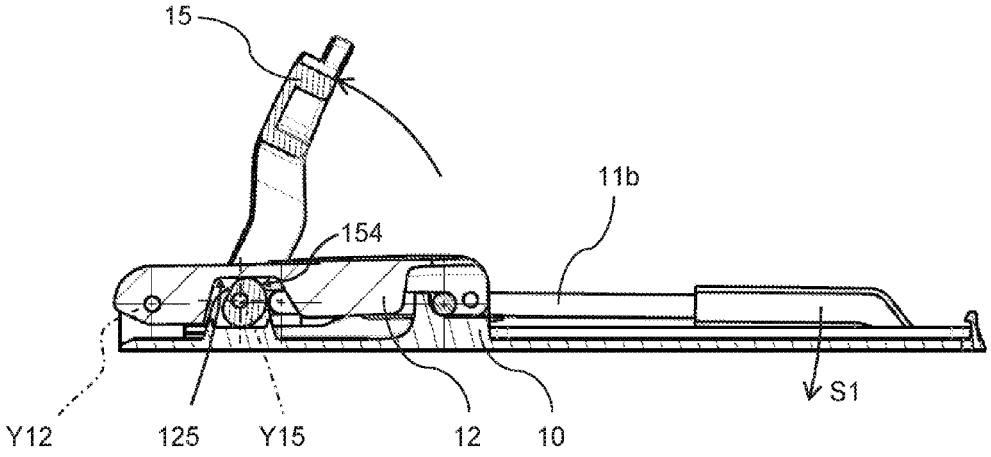
FIG. 13 is a cross-sectional view, along the line C-C of FIG. 4, illustrating a switching step of the braking device, from a locked gliding configuration to a braking configuration.

When the support plate 12 is pressed down, the control element 114 is actuated via the guiding housing 122. Thus, the guiding element is translated longitudinally within the housing, thereby resulting in the rotation of the braking arm about its axis Y11 in the direction S2. The braking device then reaches a switching/tilting configuration in which the first axis of rotation Y11, the second axis of rotation Y12, and the axis of revolution Y114 of the control element are aligned in the same plane. In this example, they are aligned in the same plane as the plane of the braking arm. This switching/tilting configuration is illustrated in FIGS. 11 and 13. The guiding element 114 has reached an end position in its guiding housing. To obtain this switching/tilting configuration, the front surface 1221 of the guiding housing must be sufficiently spaced from the rear surface 1222 so as not to interfere with the displacement of the guiding element.

Figure 6:
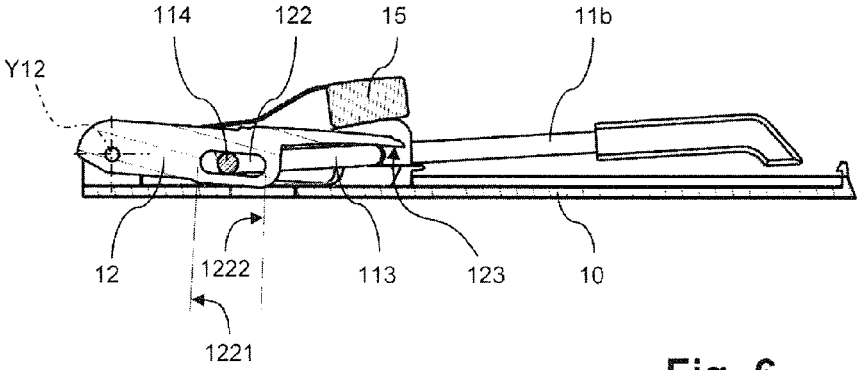

When the support plate 12 is further rotated, the control element 114 returns to the rear surface 1222 within its guiding housing 122. The rotation of the support plate 12 is however limited by an abutment. In this example, as seen in FIG. 6, a lower abutment surface 123 comes into contact with a portion of the braking arm, in this case the inner portion 113. Alternatively, the plate can abut against a surface or arrangement of the base. When the support plate is in abutment, the outer portion 112 of the braking arm is raised above the upper surface 21 of the ski. No element of the brake hampers the gliding of the ski. In this case, the braking arm 11*a* can no longer rotate further in the second direction S2. This second extreme configuration, illustrated in FIGS. 2, 6, 8, and 12, corresponds to the locking configuration of the braking device. In this configuration, the axis of revolution Y114 of the control element is positioned below the plane defined by the first axis of rotation Y11 and the second axis of rotation Y12.

Gliding configuration of the braking device refers to a configuration for which the outer portion 112 is sufficiently raised so as to no longer project beyond the sole 22 of the ski and, therefore, to no longer slow down the displacement of the ski. Consequently, the locking configuration, previously described, is a first gliding configuration.

Figure 7:
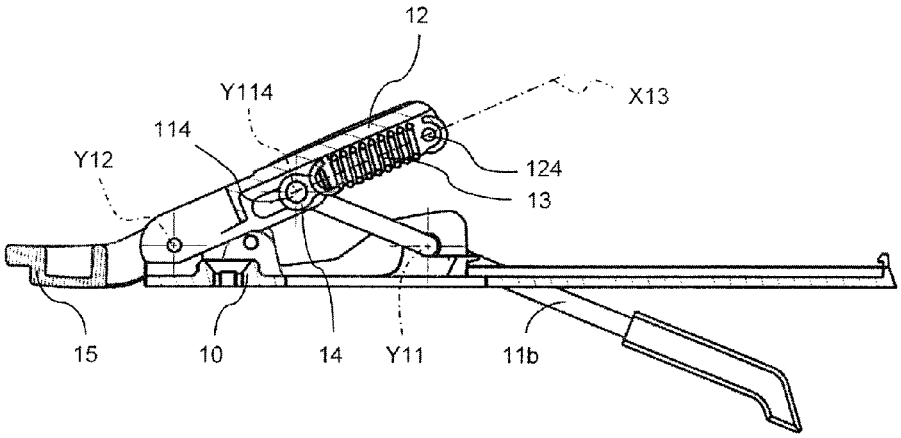
FIGS. 7 and 8 are cross-sectional views, along the line B-B of FIG. 4, illustrating the braking device in the braking configuration and the braking device in the locked gliding configuration, respectively.

To ensure the operation of the brake, the device comprises a spring or elastic mechanism 13 acting on the control element 114 so as to return it to a defined position of the guiding housing 122. In this example, the elastic mechanism is a tension spring, one end of which is fixed to a shaft 124, supported by the support plate 12 at its rear end, and the other end of which is fixed to a connecting element 14 connecting the control element 114 of a braking arm 11*a* to the control element of the other braking arm 11*b*. The spring is laterally centered in relation to the support plate 12. The spring 13 is dimensioned such that it is in tension when the braking device is in its braking configuration, as shown in FIG. 7. The spring acts on the control element 114 along a direction of actuation X13 varying as a function of the angular position of the braking arm (in the fixed reference XYZ connected to the ski). The spring 13, the shaft 124, and the connecting element 14 are arranged so that the spring 13 tends to return the control element 114 to the rear surface 1222 of the guiding housing 122, regardless of the configuration of the braking device.

The elastic mechanism 13 thus enables the braking device to have two stable configurations.

The first stable configuration of the braking device corresponds to the braking configuration described above and shown in FIG. 7.

A first unstable configuration of the braking device is obtained when the support plate 12 pivots in a first positioning range, placing the braking device in a configuration between this braking configuration and the switching/tilting configuration described above. As soon as the support plate 12 is released, the elastic mechanism 13 returns the device to its first stable configuration (FIG. 7). The elastic mechanism 13 thus acts on the control element 114 so as to cause rotation of the braking arm in a first direction S1 until the control element 114 comes into abutment against the rear surface 1222 of its guiding housing 122. This first unstable configuration range of the braking device thus defines the first positioning range of the support plate.

A second unstable configuration of the braking device is also obtained when the support plate 12 pivots further than previously, in a second positioning range, so as to place the braking device into a configuration beyond the switching/tilting configuration and up to the locking configuration described above. However, in this range of rotation of the plate, the elastic mechanism 13 tends to return the device to its second stable configuration. The elastic mechanism 13 thus acts on the control element 114 so as to cause rotation of the braking arm in a second direction S2, opposite the first direction of rotation S1, until the control element comes into abutment against an element of the device. In this example, the control element comes in support on the inner portion 113 of the braking arms. This second unstable configuration range of the braking device defines the second positioning range of the support plate.

Figure 8:
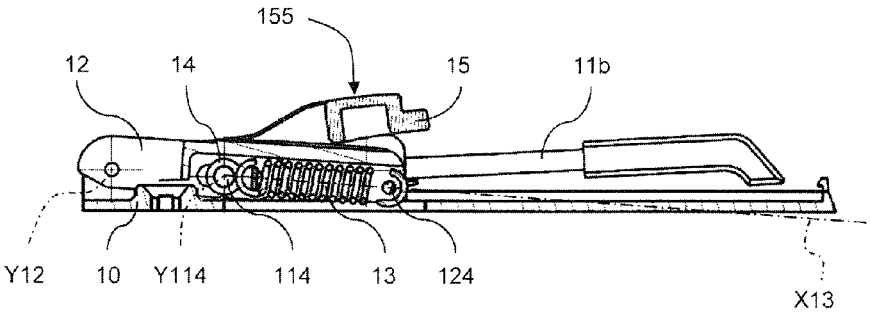
Figure 9:
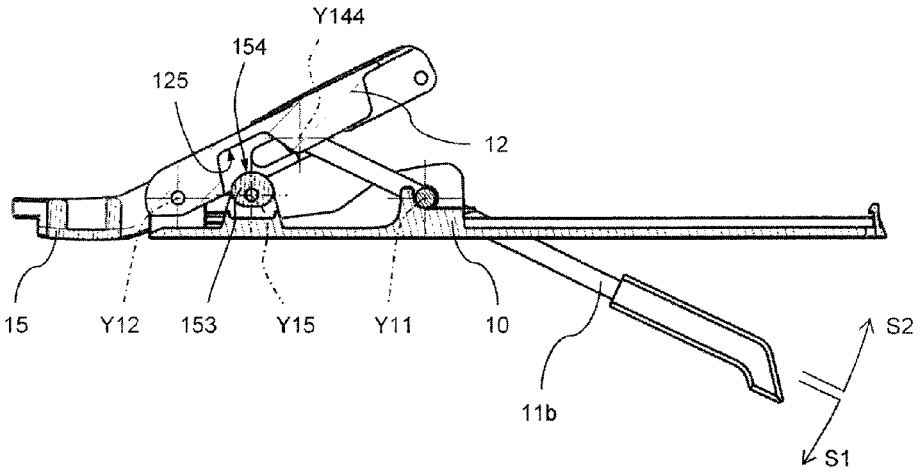
FIGS. 9, 10, 11, and 12 are cross-sectional views, along the line C-C of FIG. 4, illustrating the various switching steps of the braking device, from a braking configuration to a locked gliding configuration.

The second stable configuration of the braking device corresponds to the locking configuration shown in FIG. 8.

In the conventional constructions of the brakes of the prior art, the devices are designed for a single unstable configuration range. The support plate still remains in its first positioning range and never reaches a position placing the device in its switching/tilting configuration. The elastic mechanism only causes rotation of the braking arm in one direction S1. Therefore, there is only one stable position corresponding to the braking position. In these solutions, the brake is locked in an unstable configuration. If the lock fails, the brake switches to its single stable braking configuration.

According to the invention, the support plate 12 is designed to be displaced by an amplitude covering at least the two previously defined positioning ranges. For the first positioning range of the support plate 12, the base 10, the braking arms Ha, 11*b*, the support plate 12, and the elastic mechanism 13 are arranged so that the elastic mechanism 13 acts on the control element 114 so as to cause rotation of the braking arms in a first direction S1. For the second positioning range of the support plate 12, the base 10, the braking arms 11*a*, 11*b*, the support plate 12 and the elastic mechanism 13 are arranged so that the elastic mechanism 13 acts on the control element 114 so as to cause rotation of the braking arm in a second direction S2, opposite the first direction S1 of rotation. This characteristic thus makes it possible to obtain the two previously described stable configurations of the braking device.

In the illustrated non-limiting embodiment, the elastic mechanism 13 is a tension spring. Other types of elastic mechanisms are within the scope of the invention. Such alternatives can include springs working in compression, for example. In this case, the springs are positioned at the front of the support plate, between the second axis of rotation Y12 of the support plate and the axis of revolution Y114 of the control element. Two springs mounted in parallel and arranged symmetrically with respect to a vertical median plane XZ of the support plate can also be used. The elastic mechanism can be an element having suitable elastic properties. Furthermore, the connecting element 14 is optional, because the elastic mechanism can be directly connected to one or both control elements 114.

According to one embodiment, the tension spring 13 acts on the control element 114 along a direction X13 extending in a plane passing through the second axis of rotation Y12 of the support plate and through the axis of revolution Y114 of the control element 114 when it is housed in its guiding housing 122. This construction makes it possible to reduce parasitic friction during displacement of the control element 114 in its guiding housing 122.

In this example, the braking device comprises an actuating lever 15 for configuration of the device.

The actuating lever 15 pivots, in relation to the base 10, about a third axis of articulation Y15, substantially parallel to the second axis of articulation Y12 of the support plate, and offset towards the rear of the base. This third axis of articulation Y15 is positioned between the first axis of articulation Y11 and second axis of articulation Y12. The base 10 comprises bearings 103 for rotationally guiding the actuating lever 15. The actuating lever 15 has a U-shape comprising two lateral arms 151*a*, 151*b* connected by a crossbar 152. The third axis of articulation Y15 passes through the free ends of the lateral arms 151*a*, 151*b* of the U-shaped lever. At each of these ends, the actuating lever 15 comprises an extension 153 extending transversely towards the other end. This extension 153 supports a cam surface 154 surrounding the extension. This cam surface 154 is arranged so that when the braking device is assembled, the cam surface 154 is positioned vis-a-vis a lower contact surface 125 of the support plate 12.

The switching/tilting of the device from a braking configuration to a locking configuration will next be described.

The locking of the brake is obtained by the rearward tilting of the actuating lever 15.

In the first configuration of the braking device, called the braking configuration, the lever 15 is tilted forward until it abuts against the ski or the base. This configuration is illustrated in FIGS. 9, 1, 5, 7, and 14. In this case, the cam surface 154 is configured to interact with a lower contact surface 125 so as to limit rotation of the support plate 12, so that it can only remain in its first positioning range. The support plate 12 cannot reach a position placing the device in its switching/tilting configuration. The cam surface 154 acts as a lock having switched/tilted in an abutment configuration. The device is in a conventional alpine skiing configuration. When the heel 42 of the boot 4 presses on the upper surface 121 of the support plate 12, it causes rotation of the support plate 12 and, consequently, rotation of the braking arms 11*a*, 11*b*, until the outer portions 112 rise sufficiently so that they no longer project downward from the sole 22 of the ski 2. The braking device is in a second gliding configuration, as shown in FIG. 15. This position of the heel 42 is maintained by the heel-piece 3. When the heel-piece is released, the boot is disengaged from the binding, the heel moves away from the support plate. The spring 13 acts on the braking arms 11*a*, 11*b* to bring them in a first position in which they interact with the snow. The braking device is then in its first stable configuration corresponding to the braking configuration.

Figure 10:
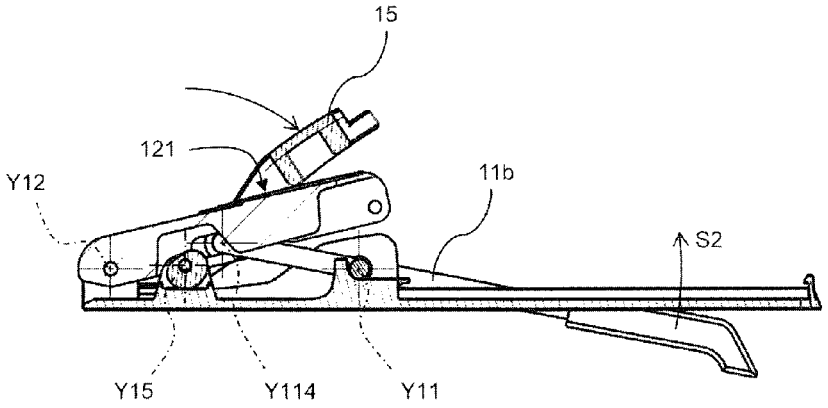

The actuating lever 15, when rotated to tilt it rearward, comes into support against the upper surface 121 of the support plate, as shown in FIG. 10.

When further rotated, the actuating lever 15 causes rotation of the support plate 12 up to a position placing the device in its switching/tilting configuration, as shown in FIG. 11. The support plate 12 can reach this positioning because the rotation of the actuating lever 15 has caused rotation of the cam surface 154, which is no longer able to interfere with the lower contact surface 125. The actuating lever 15 acts as a first actuator capable of interacting with the support plate 12 so as to cause rotation of the support plate, in order to switch/tilt it from its first positioning range to its second positioning range.

By further rotating the actuating lever 15, the support plate 12 switches/tilts into an unstable position. The spring 13 then acts on the braking arms 11*a*, 11*b* to bring them in a second position in which they are setback in relation to the upper surface 21 of the ski 2. The support plate 12 automatically continues its rotation until it comes into abutment against an element 113 of the braking device. In this case, the actuating lever 15 is no longer in contact with the support plate 12. The braking device is then in its second stable configuration corresponding to the locking configuration which is illustrated in FIGS. 12, 2, 6, and 8.

To set, i.e., to activate, the braking device, the actuating lever 15 must be switched/tilted forward. Indeed, when the actuating lever is rotated to pivot it forward, the lever reaches an angular position in which the cam surface 154 comes into contact with the lower contact surface 125 of the support plate. If the actuating lever 15 is further rotated, the cam surface 154 causes rotation of the support plate 12 until the braking device reaches its switching/tilting configuration, as shown in FIG. 13. Consequently, by further rotating the lever slightly, the support plate 12 is brought in an unstable position corresponding to the first unstable range of the braking device. The spring 13 acts on the braking arms 11*a*, 11*b* to bring them in a first position in which they interact with the snow. The support plate 12 automatically continues its rotation until the control element 114 abuts against the rear surface 1222 of its guiding housing 122. The braking device then returns to its first stable configuration corresponding to the braking configuration. The brake is set. The actuating lever 15 acts as a second actuator capable of interacting with the support plate so as to cause rotation of the support plate 12, in order to switch it from its second positioning range to its first positioning range.

Figure 16:
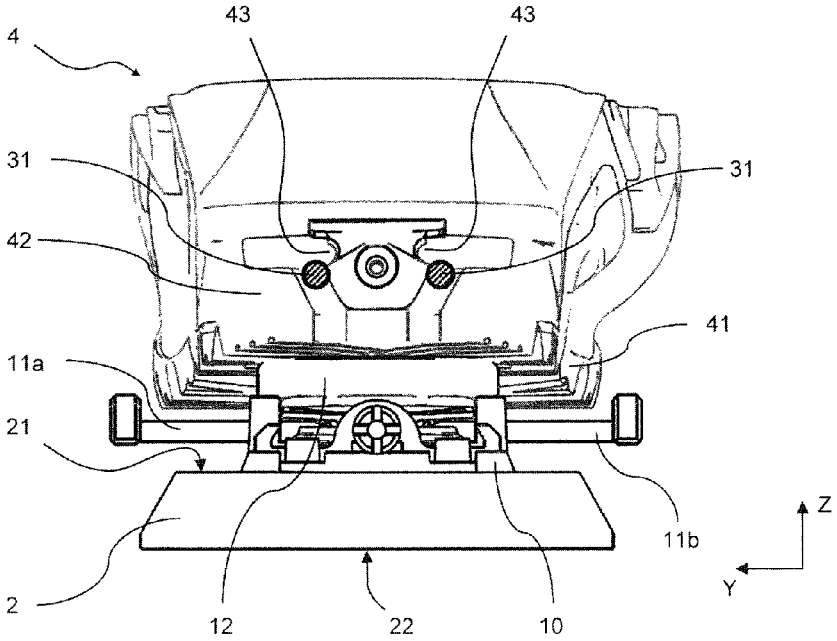
FIG. 16 is a rear view of a boot supported on the braking device locked in the gliding configuration.

Advantageously, when the braking device is in its locking configuration, the actuating lever 15 has tilted rearward and comes in support against the base 10 or a portion of the ski. In this configuration, the actuating lever 15 has a support surface 155 oriented upward, on which the sole of the boot can take support, in the area of the heel. This support surface 155 is spaced from the upper surface 21 of the ski so that, when the boot is supported on the actuating lever 15, the boot is slightly inclined forward in order to improve the support on the ski during the ascent phase. The actuating lever 15 thus acts as a conventional climbing aid. In a particular embodiment, with this arrangement, the support surface 155 is positioned so that when the heel is in contact with the actuating lever, the boot 4 cannot cooperate with a fixing element 31 of the heel-piece 3. In this example, the heel-piece 3 comprises two rods 31 corresponding to the fixing element described above. Each free end of these rods is configured to be guided in a guideway arranged in the rear surface of the heel until it is positioned in a housing 43. Once the free end of the rods 31 is positioned in the housing 43, the heel-piece is engaged. The boot is engaged with the heel-piece which prevents vertical upward movement of the heel as long as the vertical force exerted by the heel remains less than a release threshold. When the actuating lever 15 has tilted to the rear, the support surface 155 blocks the vertical downward movement of the heel 42, so that the free ends of the rods 31 cannot be positioned in their respective housing 43 of the heel 42 of the boot 4. This configuration is illustrated in FIG. 16. According to another embodiment, the fixing element of the heel-piece is a jaw rotatably mounted about a transverse axis. In any case, the actuating lever 15 acts as a retractable wedge, or intermediate element, configured to interact with the heel 42 of the boot 4 so as to limit the vertical displacement of the heel in the direction of the gliding board, so that the heel cannot engage with a fixing element 31 of a heel-piece 3 affixed to the gliding board.

Thus, when the braking device is in a locking configuration or first gliding configuration, the boot 4 cannot be engaged with the heel-piece 3. This specificity makes it possible to enhance safety during use, as it ensures that the user cannot engage the heel-piece when the braking device is in the locking configuration. Consequently, when the user wants to practice alpine skiing, he/she can engage the binding only when the brake is active or set.

According to one embodiment, the actuating lever comprises mechanisms for indexing in relation to the base, which makes it possible to maintain the actuating lever in one or more stable positions. For example, the position in which the lever is fully pivoted forward corresponds to the braking configuration of the braking device. It can also be the position in which the lever is fully pivoted rearward, which corresponds to the locking configuration of the braking device. The actuating lever can be energized between the stable positions, so that the actuating lever switches/pivots to a near stable position when it is in an intermediate position. The indexing may be carried out, for example, by a deformable lug cooperating with a complementary housing. Ramps can also be added to provide the energizing. The energizing can also be achieved by an elastic mechanism.

To prevent unintentional unlocking of the braking device, the latter may comprise a retaining mechanism for retaining the braking device in its second unstable configuration range. Unintentional unlocking can occur, for example, by action on the braking arms, in particular by pressing downward on the pivoted outer portions. To maintain this locking configuration, it is important to limit the rotation of the support plate so that it remains in its second positioning range so that, in other words, it does not reach a position placing the device in its switching/pivoting configuration. The retaining mechanism may be fastening mechanisms between the actuating lever and the base. This may be clips, magnets, a movable lock, etc. Alternatively, the retaining mechanism may comprise fastening mechanisms between the support plate and the base. This may be clips, magnets, a movable lock, etc. Alternatively, the retaining mechanism can comprise fastening mechanisms between the actuating lever and the support plate. Again, this may comprise clips, magnets, or a shape interacting with a complementary shape due to the relative kinematics between these two elements, as they do not pivot about the same axis of rotation. Also within the scope of the invention is a retaining mechanism acting directly on the braking arms so as to limit their rotation. The retaining mechanism can be actuated directly by the user or through an intermediate element, such as the actuating lever 15, for example.

Figure 14:
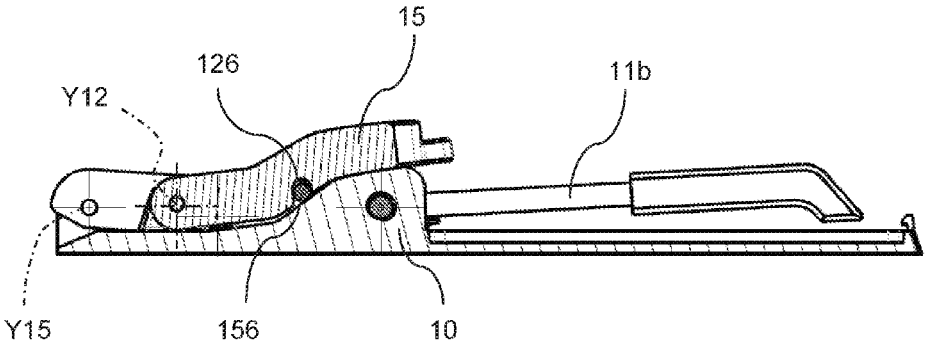
FIG. 14 is a cross-sectional view, along the line D-D of FIG. 4, illustrating the braking device in the locked gliding configuration.
Figure 15:
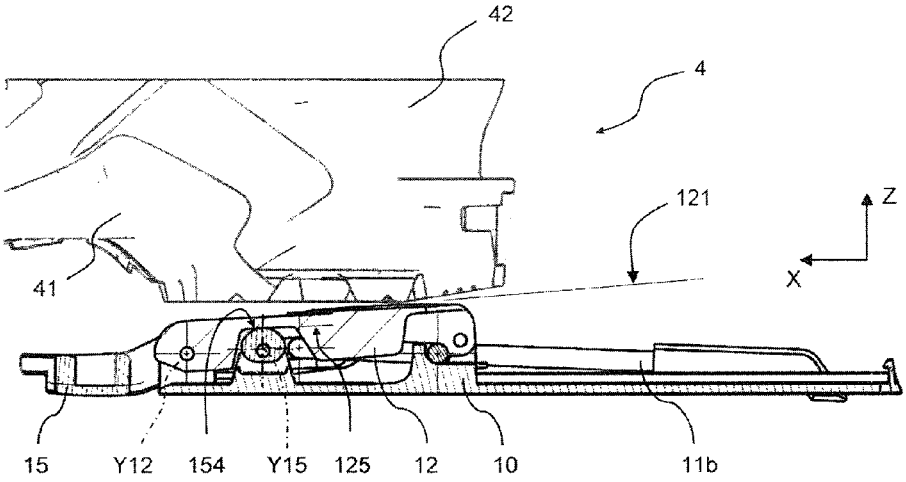
FIG. 15 is a cross-sectional view, along the line C-C of FIG. 4, illustrating the braking device in the unlocked gliding configuration.

In the illustrated example, in particular in FIG. 14, the support plate 12 comprises lateral lugs 126 projecting outward along a transverse direction. These lateral lugs are configured to cooperate with respective notches 156 arranged in the inner surface of the lateral arms 151*a*, 151*b*. When the support plate 12 has switched/pivoted into a stable position corresponding to the locking configuration of the braking device, the actuating lever can easily switch to its rear position, because the notches 156 are dimensioned to receive the lateral lugs 126 without interference. However, the dimensioning of the notches 156 is such that when the support plate is rotated forward, the lugs 126 cooperate with the notches 156 so as to become wedged, thereby blocking the rotation of the support plate so that it remains in its second positioning range. This construction enables self-locking of the braking arms. Indeed, the operation is irreversible. Thus, one can act freely on the actuating lever in one direction and cause rotation of the support plate in the same direction. One can also act freely on the actuating lever in the other direction. However, when acting on the support plate in the other direction, the rotation thereof is blocked by the retaining mechanism. Furthermore, in this case, the more rotation of the support plate is forced in the other direction, the more the kinematics is blocked. Thus, the retaining mechanism is achieved by an interaction between an element of the support plate 12, namely the lugs 126, and an element of an actuating lever 15, namely the notches 156. To obtain the self-locking, the actuating lever moves along a direction distinct from that of the support plate. Here, the axis of rotation Y15 of the actuating lever is distinct from the axis Y12 of the support plate. Alternatively, the support plate can be translated. In this case, the actuating lever should not be translated along the same direction as the support plate. The support plate and the actuating lever can be provided to have distinct movements. One may rotate while the other translates.

The illustrated embodiment has shown that the actuating lever 15 has a plurality of functions. It can act as a lock, a first actuator, a second actuator, and a wedge. Alternatively, each of these functions may be carried out by an independent, distinct element. Similarly, the same element can perform one, two, or three of the aforementioned functions.

In the description, the braking device has a simple conventional brake structure. This choice has essentially made it possible to simplify the description. It is understood that the invention also extends to other types of brakes. For example, the invention is particularly well configured as a so-called retractable brake structure, such as that shown in the patent documents U.S. Pat. Nos. 4,383,699 or 7,819,418, the disclosures of which are incorporated by reference thereto in their entireties. Retractable brakes are constructed so that the outer portions of the braking arms are offset laterally, when the braking device is in a gliding configuration, in order to be positioned above the upper surface of the ski. In this case, the connection between the braking arm and the base may be a sliding pivot connection rather than a pivot connection. The braking arm is pivotable about the axis of rotation Y11 and/or translatable laterally in relation to this axis. Guiding ramps are arranged in the constituent elements of the brake to cooperate with a portion of the braking arms in order to enable the desired kinematics. In another variant, the connection between the braking arm and the base is a ball joint connection, optionally with the ability to move the braking arm transversely.

In the description, the term "substantially" is used to describe the element arrangement in relation to a reference point: an axis or element being "substantially" parallel, perpendicular, or transverse. This term means that the orientation can vary by an angle of more or less than 30 degrees. For example, with a so-called retractable brake, the kinematics of the braking arms is complex, which means that the braking arms do not necessarily, and continuously, rotate about a transverse axis. Similarly, the braking arms may comprise portions arranged differently, with a specific angle between such portions. Therefore, it is desirable to allow a tolerance in this arrangement characteristic to cover the constructional variations directed to the same inventive concept.

In this example, the support plate 12 is a pivotable element. Alternatively, the support plate may have a different kinematics. It can have a translational movement, or a combination of translation and rotation.

The invention is not limited to these embodiments. It is possible to combine these embodiments.

The invention is not limited to the embodiments described above but extends to all embodiments covered by the claims that follow.

Further, at least because the invention is disclosed herein in a manner that enables one to make and use it, by virtue of the disclosure of particular exemplary embodiments, such as for simplicity or efficiency, for example, the invention can be practiced in the absence of any additional element or additional structure that is not specifically disclosed herein.

The invention claimed is:

1. Braking device for a gliding board, comprising:

a base provided to be affixed to the gliding board;

at least one braking arm pivotable in relation to the base about a first axis of rotation substantially transverse to the gliding board, the braking arm comprising a control element extending along an axis substantially parallel to the first axis of rotation;

a support plate movable in relation to the base, the support plate comprising a housing guiding the control element, the control element being positioned in the guiding housing to vary as a function of an angular position of the braking arm, and an elastic mechanism acting on the control element along an actuation direction varying as a function of the angular position of the braking arm;

the support plate being configured to be displaced by an amplitude covering at least two positioning ranges, the two positioning ranges comprising:

a first positioning range in which the base, the braking arm, the support plate, and the elastic mechanism are arranged so that the elastic mechanism acts on the control element to cause rotation of the braking arm in a first direction;

a second positioning range in which the base, the braking arm, the support plate, and the elastic mechanism are arranged so that the elastic mechanism acts on the control element to cause rotation of the braking arm in a second direction, opposite the first direction of rotation; and a lock movable into an abutment configuration in which the lock is configured to interact with the support plate to limit movement of the lock so that the support plate can only remain in the first positioning range.

2. Braking device according to claim 1, wherein:

the support plate is pivotable in relation to the base about a second axis of rotation substantially parallel to the first axis of rotation.

3. Braking device according to claim 1, wherein:

the lock is further configured to comprise an actuator configured to interact with the support plate to cause rotation of the support plate in order to switch the support plate from the first positioning range to the second positioning range.

4. Braking device according to claim 1, wherein:

the lock is further configured to comprise:

a first actuator configured to interact with the support plate to cause rotation of the support plate in order to switch the support plate from the first positioning range to the second positioning range; and a second actuator configured to interact with the support plate to cause rotation of the support plate in order to switch the support plate from the second positioning range to the first positioning range.

5. Braking device according to claim 1, further comprising:

a first actuator configured to interact with the support plate to cause rotation of the support plate, in order to switch/tilt the support plate from the first positioning range to the second positioning range;

a second actuator configured to interact with the support plate to cause rotation of the support plate in order to switch/tilt the support plate from the second positioning range to the first positioning range; and the lock, the first actuator, and the second actuator form a unitary element.

6. Braking device according to claim 5, wherein:

the unitary element forming the lock, the first actuator, and the second actuator is pivotable in relation to the base about a third axis of rotation substantially parallel to the second axis of rotation.

7. Braking device according to claim 1, wherein:

the lock is further configured to comprise a retractable wedge configured to interact with a heel of a boot to limit upward displacement of the heel in the direction away from the gliding board, so that the heel cannot cooperate with a boot-fixing element of a heel-piece affixed to the gliding board.

8. Braking device according to claim 1, further comprising:

a retaining mechanism for retaining the support plate in the second positioning range.

9. Braking device according to claim 8, further comprising:

an actuating lever comprising the lock, wherein the retaining mechanism comprises an interaction between an portion of the support plate and an portion of an actuating lever, the actuating lever being movable along a direction distinct from a direction of movement of the support plate.

10. Braking device according to claim 1, wherein:

the lock movable into an abutment configuration is a lock switchable in rotation into the abutment configuration in which the lock is configured to interact with the support plate to limit rotation of the lock so that the support plate can only remain in the first positioning range.

11. Braking device for a gliding board, comprising:

a base provided to be affixed to the gliding board;

at least one braking arm pivotable in relation to the base about a first axis of rotation substantially transverse to the gliding board, the braking arm comprising a control element extending along an axis substantially parallel to the first axis of rotation;

a support plate movable in relation to the base, the support plate comprising a housing guiding the control element, the control element being positioned in the guiding housing to vary as a function of an angular position of the braking arm, and an elastic mechanism acting on the control element along an actuation direction varying as a function of the angular position of the braking arm;

the support plate being configured to be displaced by an amplitude covering at least two positioning ranges, the two positioning ranges comprising:

a first positioning range in which the base, the braking arm, the support plate, and the elastic mechanism are arranged so that the elastic mechanism acts on the control element to cause rotation of the braking arm in a first direction;

a second positioning range in which the base, the braking arm, the support plate, and the elastic mechanism are arranged so that the elastic mechanism acts on the control element to cause rotation of the braking arm in a second direction, opposite the first direction of rotation; and an actuator configured to interact with the support plate to cause rotation of the support plate in order to switch the support plate from the first positioning range to the second positioning range.

12. Braking device for a gliding board according to claim 11, wherein:

the actuator is further configured as an additional actuator configured to interact with the support plate to cause rotation of the support plate in order to switch the support plate from the second positioning range to the first positioning range.

13. Braking device for a gliding board, comprising:

a base provided to be affixed to the gliding board;

at least one braking arm pivotable in relation to the base about a first axis of rotation substantially transverse to the gliding board, the braking arm comprising a control element extending along an axis substantially parallel to the first axis of rotation;

a support plate movable in relation to the base, the support plate comprising a housing guiding the control element, the control element being positioned in the guiding housing to vary as a function of an angular position of the braking arm, and an elastic mechanism acting on the control element along an actuation direction varying as a function of the angular position of the braking arm;

the support plate being configured to be displaced by an amplitude covering at least two positioning ranges, the two positioning ranges comprising:

a first positioning range in which the base, the braking arm, the support plate, and the elastic mechanism are arranged so that the elastic mechanism acts on the control element to cause rotation of the braking arm in a first direction;

a second positioning range in which the base, the braking arm, the support plate, and the elastic mechanism are arranged so that the elastic mechanism acts on the control element to cause rotation of the braking arm in a second direction, opposite the first direction of rotation; and a retractable wedge configured to interact with a heel of a boot to limit upward displacement of the heel in the direction away from the gliding board, so that the heel cannot cooperate with a boot-fixing element of a heel-piece affixed to the gliding board.

14. Braking device for a gliding board, comprising:

a base provided to be affixed to the gliding board;

at least one braking arm pivotable in relation to the base about a first axis of rotation substantially transverse to the gliding board, the braking arm comprising a control element extending along an axis substantially parallel to the first axis of rotation;

a support plate movable in relation to the base, the support plate comprising a housing guiding the control element, the control element being positioned in the guiding housing to vary as a function of an angular position of the braking arm, and an elastic mechanism acting on the control element along an actuation direction varying as a function of the angular position of the braking arm;

the support plate being configured to be displaced by an amplitude covering at least two positioning ranges, the two positioning ranges comprising:

a first positioning range in which the base, the braking arm, the support plate, and the elastic mechanism are arranged so that the elastic mechanism acts on the control element to cause rotation of the braking arm in a first direction;

a second positioning range in which the base, the braking arm, the support plate, and the elastic mechanism are arranged so that the elastic mechanism acts on the control element to cause rotation of the braking arm in a second direction, opposite the first direction of rotation; and a retaining mechanism for retaining the support plate in the second positioning range;

the retaining mechanism comprising an interaction between a portion of the support plate and a portion of an actuating lever, the actuating lever being movable along a direction distinct from a direction of movement of the support plate.

* * * * *